US011992070B2

(12) United States Patent
Huh et al.

(10) Patent No.: US 11,992,070 B2
(45) Date of Patent: May 28, 2024

(54) FACE SHIELD SYSTEMS FOR SECURING REMOVABLE FACE SHIELD LENSES

(71) Applicant: Illinois Tool Works Inc., Glenview, IL (US)

(72) Inventors: Moon Young Huh, Seoul (KR); Mitchell James Muske, Neenah, WI (US)

(73) Assignee: Illinois Tool Works Inc., Glenview, IL (US)

( * ) Notice: Subject to any disclaimer, the term of this patent is extended or adjusted under 35 U.S.C. 154(b) by 130 days.

(21) Appl. No.: 16/943,438

(22) Filed: Jul. 30, 2020

(65) Prior Publication Data

US 2022/0030977 A1 Feb. 3, 2022

(51) Int. Cl.

| | |
|---|---|
| ***A41D 13/11*** | (2006.01) |
| ***A41D 13/002*** | (2006.01) |
| ***A42B 1/041*** | (2021.01) |
| ***A42B 1/247*** | (2021.01) |
| ***A42B 3/22*** | (2006.01) |
| ***A42B 3/32*** | (2006.01) |

(52) U.S. Cl.

CPC ..... *A41D 13/1184* (2013.01); *A41D 13/0025* (2013.01); *A41D 13/1161* (2013.01); *A42B 1/041* (2013.01); *A42B 1/247* (2013.01); *A42B 3/221* (2013.01); *A42B 3/225* (2013.01); *A42B 3/32* (2013.01)

(58) Field of Classification Search

CPC .. A42B 3/18; A42B 3/22; A42B 3/221; A61F 9/06; A61F 9/061; A61F 9/062; A61F 9/064; A61F 9/065; A61F 9/067

See application file for complete search history.

(56) References Cited

U.S. PATENT DOCUMENTS

| | | | | |
|---|---|---|---|---|
| 3,458,865 | A * | 8/1969 | Boyer | A61F 9/06 2/8.1 |
| 6,047,409 | A * | 4/2000 | Simpson | A42B 3/223 2/424 |
| 6,102,033 | A | 8/2000 | Baribeau | |
| 7,895,680 | B2 * | 3/2011 | Anderson | A42B 3/18 2/427 |
| 9,999,546 | B2 * | 6/2018 | Gardner | A61F 9/068 |

(Continued)

FOREIGN PATENT DOCUMENTS

| | | |
|---|---|---|
| WO | 2019079162 | 4/2019 |

OTHER PUBLICATIONS

European Search Report for European Patent Application No. 21177551.5, dated Nov. 26, 2021. 6 pages.

*Primary Examiner* — Katherine M Moran

(74) *Attorney, Agent, or Firm* — McAndrews, Held & Malloy, Ltd.

(57) ABSTRACT

An example face shield includes a face shield lens comprising a locking channel, a face shield shell configured to receive the face shield lens when the face shield is inserted into the face shield shell, and a lens lock configured to move between: a locked position in which the lens lock is configured to engage the locking channel of the face shield to secure the face shield lens to the face shield shell; and an unlocked position in which the lens lock is configured to disengage the locking channel of the face shield to permit insertion of the face shield to the face shield shell and removal of the face shield from the face shield shell.

16 Claims, 7 Drawing Sheets

(56) References Cited

U.S. PATENT DOCUMENTS

| | | | | |
|---|---|---|---|---|
| 11,219,265 | B2 * | 1/2022 | Pfanner | A42B 3/225 |
| 2012/0291173 | A1 | 11/2012 | Gleason | |
| 2014/0053307 | A1 * | 2/2014 | Cheng | A61F 9/06 2/8.2 |
| 2016/0074230 | A1 * | 3/2016 | Sernfält | A42B 3/225 2/8.3 |
| 2016/0175624 | A1 * | 6/2016 | Balke | A62B 18/003 128/847 |
| 2018/0161208 | A1 * | 6/2018 | Huh | A61F 9/025 |
| 2020/0375281 | A1 * | 12/2020 | Prevot | A61F 9/029 |

* cited by examiner

FACE SHIELD SYSTEMS FOR SECURING REMOVABLE FACE SHIELD LENSES

BACKGROUND

This disclosure relates generally to personal protective equipment and, more particularly, to face shield systems for securing removable face shield lenses.

Face shields are often used to protect a user's eyes and face while performing certain tasks such as grinding or pressure washing. Over time, the lenses of face shield systems can either become dirty, contaminated, or experience wear due to the debris the face shields are designed to deflect. As a result, some conventional face shields allow for removal and replacement of these lenses. Conventional lens replacement requires significant time and effort to remove the used lens and install the replacement lens.

The face shields can further integrate a positive air pressure respirators which provide the additional benefit of supplying purified air to the wearer without requiring the user to don additional personal protective equipment, such as a separate respirator. As with the lenses, the materials used to create a seal to a wearer's head may become dirty or worn. The traditional systems also often require significant time and effort to remove the used lens and install these seal components, or else may be prone to inadvertent release.

SUMMARY

Face shield systems for securing removable face shield lenses are disclosed, substantially as illustrated by and described in connection with at least one of the figures, as set forth more completely in the claims.

BRIEF DESCRIPTION OF THE DRAWINGS

The figures are not to scale. Where appropriate, the same or similar reference numerals are used in the figures to refer to similar or identical elements.

DETAILED DESCRIPTION

Figure 1:
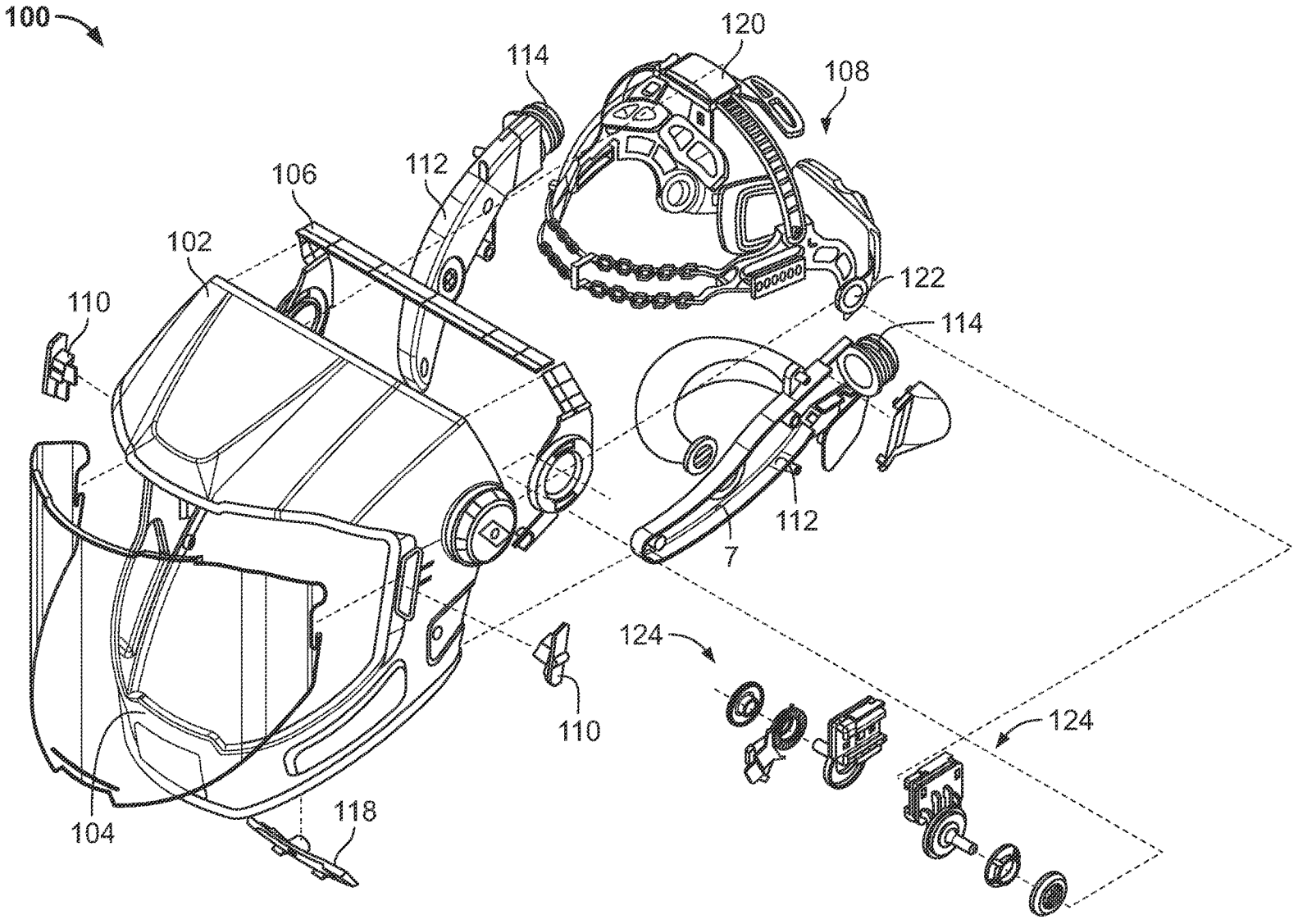
FIG. 1 is an exploded view of an example face shield system having a face shield shell, a face shield lens, and a head seal, in accordance with aspects of this disclosure.

Individuals wear face shields for protecting the wearer's face from various harms. Commonly, face shields are used to protect an individual from airborne debris from metal-working or similar processes during activities such as grinding or cutting with power tools. Face shields can also guard against sprays from various sources, such as pressurized piping or even sneezing humans. Unlike safety glasses, a face shield protects the entire face instead of just the wearer's eyes from the hazardous debris. This configuration also minimizes the risk of debris reaching the eye from more angles angle as compared to traditional safety glasses while also limiting obstructions to peripheral vision.

Traditional face shields often use a flexible polycarbonate lens. Though many of the traditional face shields may have replaceable lenses to allow for exchanging damaged or worn lenses, the wearer may be hesitant to replace the lens because of the time intensive and difficult process involved. The traditional process often includes bending both the lens and/or the shell of the face shield in which the lens is mounted. The shell often has a series of channels in which the user must insert the lens while either the lens and/or the shell are distorted. Improper installation may result in a gap between the lens and the shell creating an opening for debris to get past the shield. Additionally, an improperly installed lens may not provide the full protection against debris impact. By simplifying the process, a user could potentially remove and re-install the face shield lens without removing the face shield shell from the user's head allowing for greater flexibility of lens selection such as tinted lenses for bright light environments.

Relatedly, the hazardous types of work that require a face shield also often also require breathing protection in the form of a respirator. In many cases, the user will wear the respirator underneath the face shield. Standard respirators are often bulky, heavy, may restrict breathing, and/or require special fitting tests prior to use. Some systems integrate these requirements into the face shield in the form of a Positive Air Pressure Respirator ("PAPR"), sometimes also referred to as a "Powered Air Purifying Respirator." By adding a seal between the face shield and the user's head, an air hose can provide filtered air to the wearer's face while minimizing the negative effects of standard respirators. Additionally, these seals provide an additional barrier to the airborne debris reaching the user's face. The PAPR system further prevents the debris infiltration because the higher pressure creates an air barrier against particulate debris.

Disclosed are example face shield systems and methods for removing and installing various components of the face shield systems. In some example systems and methods, the face shield uses a removable face shield lens and a face shield shell which holds the lens during normal use. The face shield shell uses a lens lock to secure the lens for use, and further examples release of the lens for ease of replacement.

Also disclosed are example face shields with integrated using PAPR systems for breathing protection. The disclosed examples describe methods and systems for removing and replacing various components mounted to the face shield shell. By using mechanical attachment locations, these components may be removed and replaces with less effort and time. These systems also minimize the risk of inadvertent release of the attachment locations.

As used herein, the terms "first," "second," "third," etc., are used to enumerate instances of similar or identical elements, and do not indicate or imply order unless an order is specifically identified.

As used herein, the term "inner surface" refers to the portion of a given component closest to the user's head and the term "outer surface" refers to the portion of a given component away from the user's head.

Turning now to the drawings, FIG. 1 is an exploded view of an example face shield system 100 having a face shield shell 102, a face shield lens 104, and a head seal 106. The face shield shell 102 provides the primary attachment point for the other portions of the face shield system 100. For purposes of illustration, the user's head 108 is depicted.

In some examples, the face shield shell 102 includes lens locks 110. In some examples, the lens lock 110 has at least two positions. During normal use, the lens lock 110 is kept in a locked position that prevents removal of the face shield lens 104. When the user desires to replace the face shield lens 104, the user places the lens lock 110 in the unlocked condition which allows the first face shield lens 104 to be removed and a second face shield lens 104 to be installed. Once the second face shield lens 104 is installed, the user returns the lens lock 110 to the locked condition to retain the face shield lens 104 within the face shield shell 102. As shown, the face shield shell 102 covers the front portion of the user's face. In some examples, the face shield shell 102 could be integrated into a helmet which would cover the front of the user's face as well as the top of the user's head.

In some examples, the face shield system 100 also includes air ducts 112, which may be coupled to air supply hoses via hose connectors 114 for connection to a PAPR system. The example air ducts 112 may cooperate with the inner surface of the face shield shell 102 to direct air from the hose connectors 114 into the face shield system 100 to enable the user to breathe the supplied air. The example ducts 112 include air outlets 116, which direct the air toward the user's face. The outlets 116 provides the filtered air to within a cavity created between the face shield shell 102, the face shield lens 104, the head seal 106, and the user's head 108. In addition to providing the air for breathing, the air outlets 116 may also provide a cooling effect to the user and/or conduct expirations by the user away from the user's face.

The example The PAPR system may include a replaceable air filter to remove certain contaminants from the air. The air filter may conform to certain governmental standards such as the U.S. National Institute for Occupational Safety and Health (NIOSH), and be rated based on the amount and type of particulate filtered from the air. In some examples, the air supply device also includes an electrical motor for supplying the air through the system to the face shield system 100 via the ducts 112. The electrical motor may be connected to a fan, a positive displacement pump, or other similar device. The air supply device draws air from the surrounding area, through the air filter, through the air supply device, and to the user's face within the face shield shell 102 via the hose connectors 114, the ducts 112, and the outlets 116. In some examples, the air supply device may be worn by the user at the waist on a belt or on a harness on the user's back or chest.

In some examples, the air supply device monitors either the discharge pressure; a differential pressure, for example across the filter; or volume of airflow at the discharge of the air supply device. Low airflow can be a sign the air filter may need to be replaced. In some examples, the air supply device may provide an audible, visual, or haptic indication to the user to indicate the status of the filter or the need to replace the filter. The air supply device may provide these indications, or else send a signal to the face shield shell to provide these indications. In some examples, the filter life may be determined based on a time of use instead of, or in addition to, the pressure drop across the filter. In some examples, the status of the filter may be shown as a useful life percentage, a time remaining, a qualitative status (such as "good" or "needs replacement"), etc. In some examples, the air supply device may adjust the speed of the motor to maintain a constant output pressure or airflow through the air supply hose.

The head seal 106 closes any large gaps between the face shield shell 102 and the top of the user's head 108. As described in more detail below, the head seal 106 may be attached to a shroud that extends from the head seal 106 to around the back of the user's head 108. The number and size of gaps between the various components of the face shield system 100 and the user's head 108 are reduced or minimized. However, some air leakage is expected and required by the PAPR type system to vent excess air as well as the air exhaled by the user, thereby preventing infiltration of environmental gasses and/or contaminants into the interior of the face shield system 100. The continual replenishment of filtered air minimizes the buildup of carbon dioxide, excess moisture, and other gasses from the user's breathing within the face shield shell 102.

The example face shield system 100 further includes a chin seal 118 attached to the face shield shell 102 and configured to reduce gaps between the face shield shell 102 and the user's chin. In some examples, the chin seal 118 may include or be attached to a flexible (e.g., elastic) shroud that is biased into contact with the user's chin and/or neck.

The example face shield shell 102 is supported on the user's head by a headgear 120. The headgear 120 securely attaches to the front, rear, and/or top of the user's head 108, and may be adjustable to enable a comfortable and secure fit to different user's heads. The face shield shell 102 is coupled to the headgear 120 at pivot points 122 on the sides of the headgear 120 via pivoting clips 124. The pivoting clips 124 couple the face shield shell 102 to the headgear 120 to support the face shield shell 102. The pivoting clips 124 permit the face shield shell 102 to be pivoted with respect to the headgear 120, in which the axes of rotation are the pivot points 122.

The headgear 120 may operate as a suspension system and to provide attachment points for the face shield shell 102. In this manner, the suspension system provided by the headgear 120 provides some flexibility between the rigid face shield shell 102 and the user's head 108.

Figure 2A:
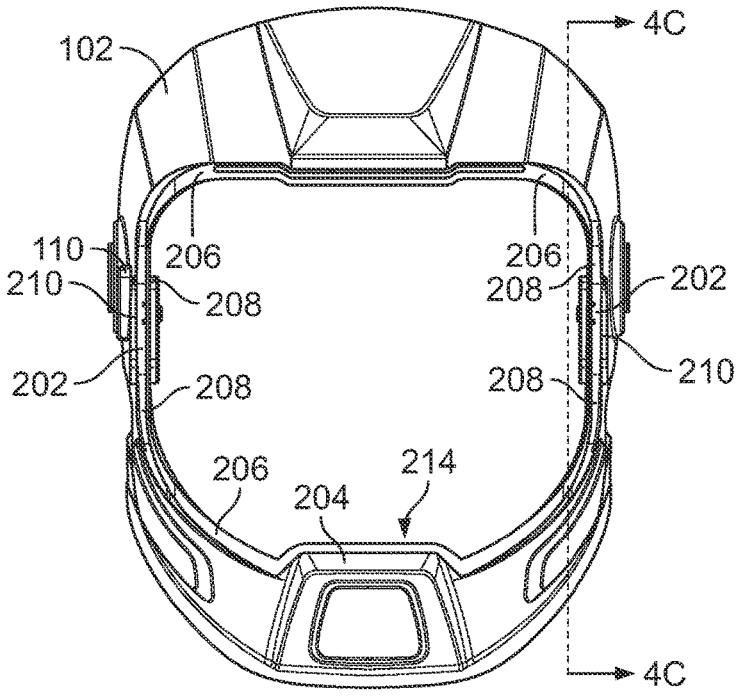
FIG. 2A is a front elevation view of the example shell of FIG. 1.
Figure 2B:
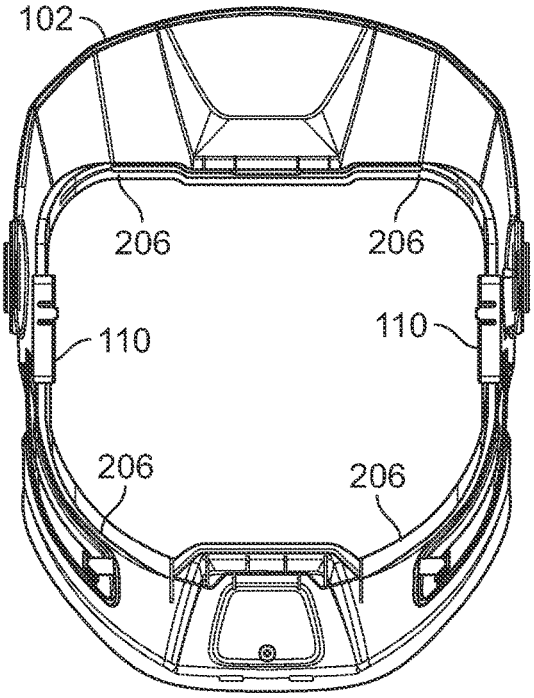
FIG. 2B is a rear elevation view of the example shell of FIG. 2A.
Figure 2C:
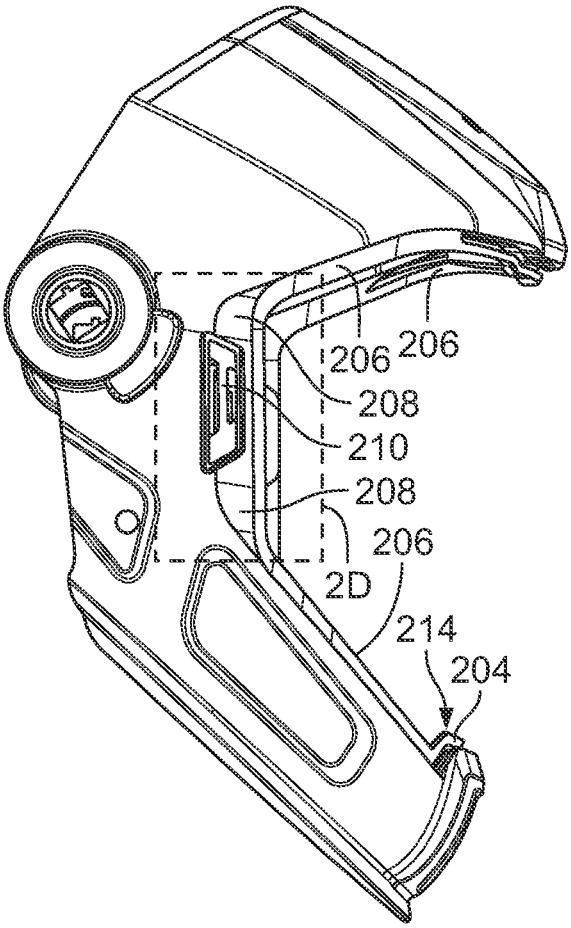
FIG. 2C is a perspective view of the face shield shell of FIG. 2A.

FIG. 2A is a front elevation view of the example face shield shell 102 of FIG. 1, showing an exterior surface of the face shield shell 102. FIG. 2B is a rear elevation view of the face shield shell 102, showing an interior surface of the face shield shell 102. FIG. 2C is a perspective view of the face shield shell 102. The example lens locks 110 are located on one or both sides of the face shield shell 102.

Figure 2D:
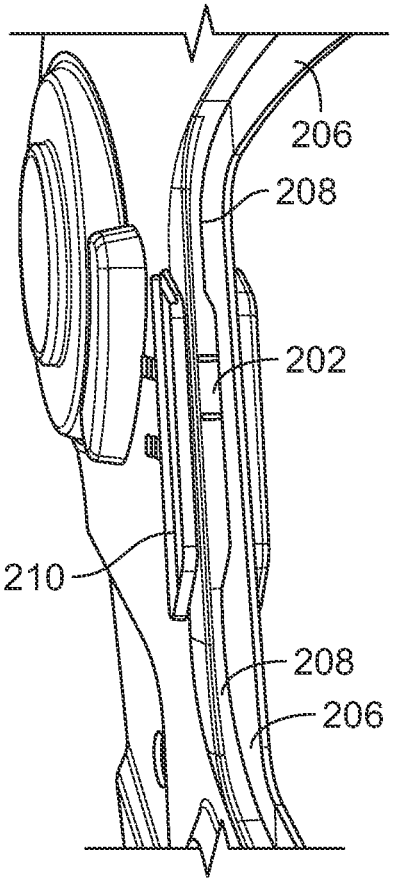
FIG. 2D is a more detailed view of a portion of the face shield shell of FIG. 2C illustrating the shell lock channel.

The example face shield shell 102 has a shell lock channel 202. The shell lock channel 202 may be configured to accept the portion of a face shield lens locking channel of the face shield lens 104. FIG. 2D is a more detailed view of a portion of the face shield shell 102 illustrating the shell lock channel 202. The shell lock channel 202 may also provide support and/or a sealing location to the inner surface and outer surface of the face shield lens 104.

The face shield shell 102 further includes a lens channel 204. In the example in FIGS. 1-2D, the lens channel 204 is at the bottom portion of the face shield shell 102. However, the lens channel could be on one of the sides, the top of the face shield shell, or at an intermediary location between those areas. When installing the face shield lens 104, the user first inserts the face shield lens 104 into the lens channel 204. In some examples, the top of the outer surface of the lens channel 204 creates a lens insertion flange 206. The lens insertion flange 206 abuts the face shield lens 104 to provide a hard stop for the user installing the face shield lens 104. The shapes of the lens channel 204 and the lens insertion flange 206 aid in alignment of the face shield lens 104 during installation into the face shield shell 102. In some examples, when the face shield lens 104 is fully installed into the face shield shell 102, the lens channel 204 and lens insertion flange 206 provide support and a sealing surface to the inner surfaces of the face shield lens 104.

In some examples, the face shield shell 102 will also have a face shield groove 208. The face shield groove 208 may provide additional alignment for the other edges of face shield lens 104 adjacent the shell lock channel 202. Due to the positive pressure created by the air supply device, minor leakage between the face shield shell 102 and the face shield lens 104 is permitted due to the lack of a gasket or other seal between the face shield shell 102 and the face shield lens 104. In some examples, a gasket type material may be applied to the lens insertion flange 206 or the corresponding shell mating surface on the face shield lens 104 to further limit the air leakage around the face shield lens 104.

The lens lock 110 extends through the face shield shell 102. In some examples one or more lens lock tracks 210 may define the path of movement for the lens lock 110. In some examples, the lens lock track 210 may be linear as shown. In some examples, the lens lock 110 will cover the lens lock track 210 in both the open and locked positions. In other examples, the lock track is curved. In some examples such as shown in FIG. 2B, the lens lock may snap fit into the inner surface of the face shield shell 102. In other examples, the lens lock 110 may not extend through the inner surface of the face shield shell 102. In yet other examples, the lens lock may rotate about a lock pivot point to engage the face shield channel.

Figure 3A:
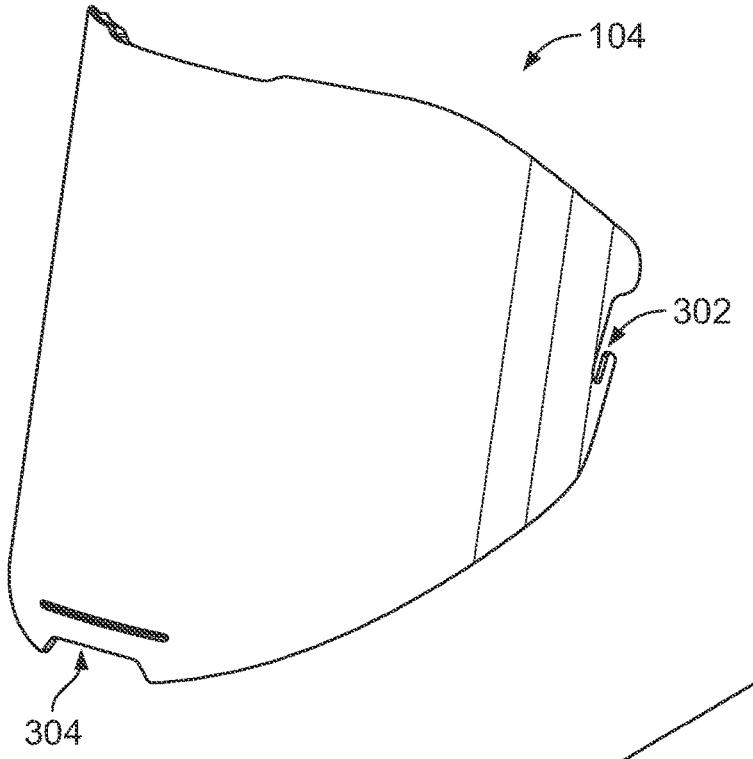
FIG. 3A is a perspective view of the outer surface of the face shield lens of FIG. 1.
Figure 3B:
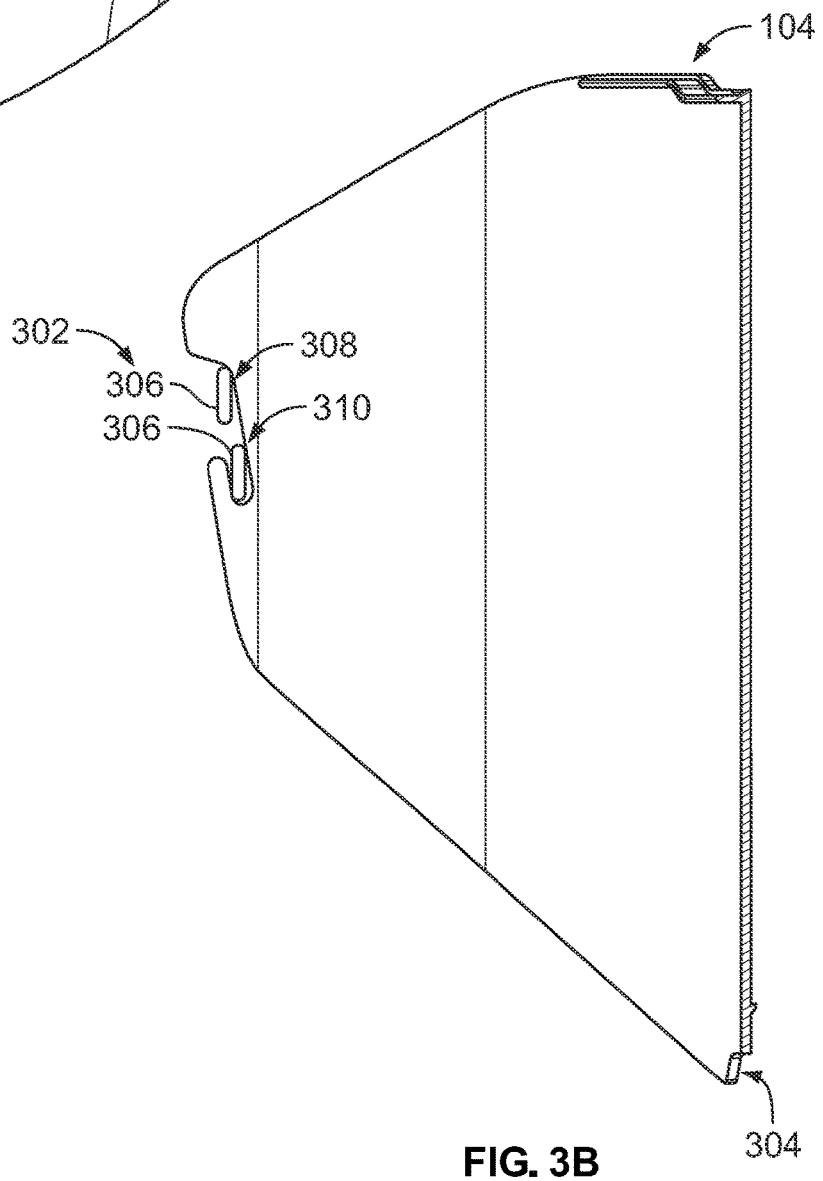
FIG. 3B is a side elevation view of the example lens of FIG. 3A, illustrating a shell locking channel that may be used to selecting lock or secure the face shield lens to the face shield shell.

FIG. 3A is a perspective view of the outer surface of the face shield lens 104. FIG. 3B is a side elevation view of the face shield lens 104, illustrating a shell locking channel 302 that may be used to selecting lock or secure the face shield lens 104 to the face shield shell 102. The example face shield lens 104 is constructed of a uniform thickness polycarbonate plastic. However, other materials may be used.

In some examples, a user may possess a series of face shield lenses which may be tinted to varying degrees. The user may select a different tinted lens based on the working conditions and the task at hand. For example, the user may have an un-tinted lens for normal usage. The user may also have a dedicated tinted lens for work outdoors. The user may also have different tinted lens for grinding or welding operations. In some examples, the lens may be provide with auto-darkening features for welding purposes.

The example face shield lens 104 of FIGS. 3A and 3B has locking channels 302 on either side of the lens 104. The locking channels 302 engage the lens lock 110 of FIG. 1 when the locking channels 302 are inserted into the corresponding shell lock channels 202 and the lens lock 110 is moved into the locked position. When locked, the lens locks 110, the shell lock channels 202, and the locking channels 302 cooperate to hold the face shield lens 104 in place on the face shield shell 102.

In other examples, portions of the face shield lens 104, such as the locking channel 302 and/or portions in contact with the lens insertion flange 206, may be thicker than the remaining portions of the face shield lens 104 to provide greater strength and rigidity to the locking channel 302. In some examples, the lens lock 110 engages the locking channel 302 to create a tensile force on the face shield lens 104 to force the mating areas onto the face shield shell 102. In other examples, the face shield lens 104 may have a locking channel 302 only on one side of the lens or at a different location on the lens such as the top or the bottom of the face shield lens 104. In these other examples, the lens lock may use tension and/or compression forces as the lens lock 110 engages the outer surface of the face shield lens 104 to improve conformance of the face shield lens 104 to the lens insertion flange 206.

As shown in FIG. 3A, the locking channel 302 is a linear shape to correspond to the lens lock track 210 of FIG. 2B. In other examples, the locking channel 302 may take other shapes to correspond to other configurations and/or other methods of mounting the lens lock 110 to the face shield shell 102 to allow the lens lock 110 to enter the locking channel 302 when in a locked position and exit the locking channel 302 when moved to the unlocked position.

The face shield lens 104 also has a channel centering indent 304. The channel centering indent 304 may be configured to abut against the lens centering contour 214 to aid in the alignment of the face shield lens 104 centerline with the face shield shell 102 centerline.

As mentioned above, the lens channel 204 of the face shield shell 102 may improve alignment of the face shield lens 104 when inserted into the face shield shell 102. As illustrated in FIGS. 2A and 2C, the face shield shell 102 may align the lens 104 using a lens centering contour 214. As illustrated in FIG. 3A, the face shield lens 104 has a corresponding channel centering indent 304. As shown, when the user inserts the face shield lens 104 into the lens channel 204, the channel centering indent 304 will abut against the lens centering contour 214 thus aiding the user to align the centerlines of the face shield lens 104 with the centerline of the face shield shell 102. The user may align the channel centering indent 304 with the lens centering contour 214 prior to inserting the shell locking channels 302 of the face shield lens 104 into the shell lock channels 202 of the face shield shell 102.

In some examples, the face shield lens 104 is at least 0.07 inches thick. At this thickness, the face shield lens is unlikely to bend while inserted or removed from the face shield shell 102, and/or may allow some flexing during insertion and removal from the face shield shell 102, but provide adequate protection to the user during normal use.

In other examples, the face shield may only have a lens lock 110 on one side of the face shield shell 102 and a lens channel 204 on the opposite side. In some of these examples, the lens channel 204 may also have a lens insertion flange 206 and/or a lens centering contour 214. Instead of aligning the centerlines of the face shield shell 102 and face shield lens 104, the channel centering indent 304 and the corresponding lens centering contour would act to aid in the vertical alignment of the face shield lens 104. In yet other examples, an interlocking hinge or other releasable feature may join the face shield shell 102 and face shield lens 104 opposite the side opposite of the single lens lock 110.

In some examples, the face shield shell 102 may have a lens channel 204 at the bottom and/or top of the shell 102, and have a single lens lock on the opposite horizontal edge. In this example, the face shield shell 102 may also have a second and/or third lens channel on either side of the face shield shell 102 to provide support to the inner and outer surfaces of the face shield lens 104.

Figure 4A:
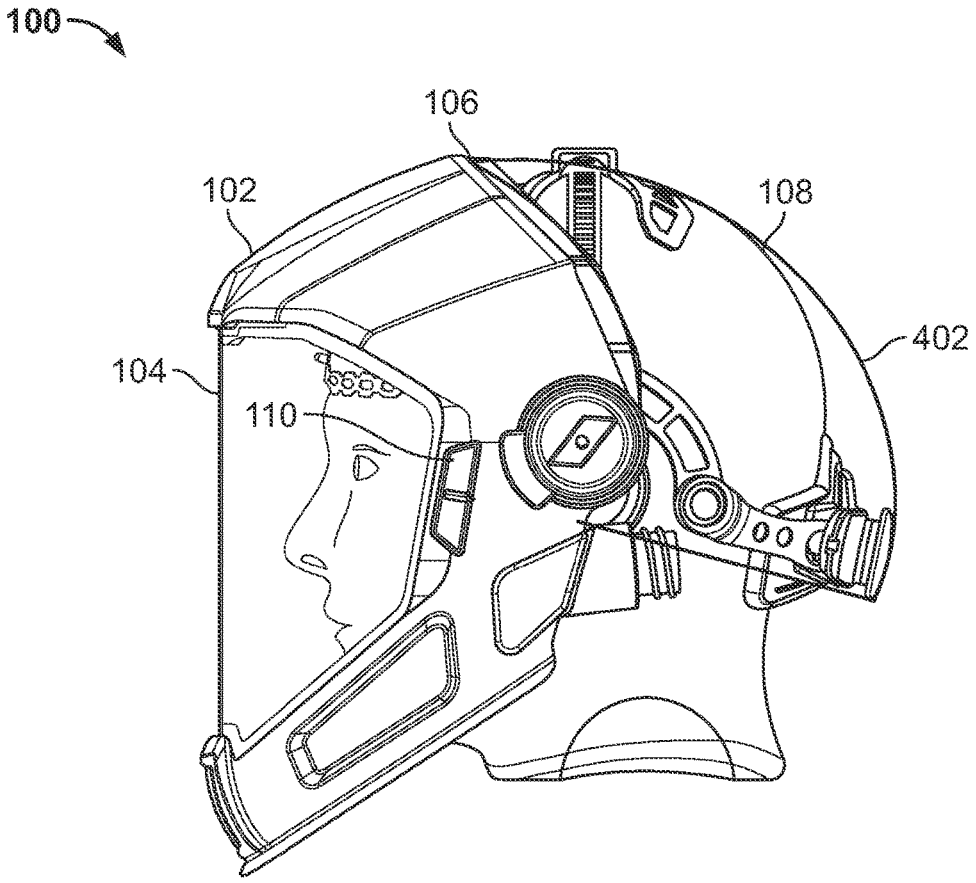
FIG. 4A is a side elevation view of the example face shield system of FIG. 1

FIG. 4A is a side elevation view of the example face shield system 100 of FIG. 1. The face shield system 100 of FIG. 4A illustrates one of the lens locks 110, and the head seal 106 attached to a head shroud 402. The head seal 106 creates a barrier to airflow between the face shield shell 102 and the user's head 108 in a PAPR type system.

The lens lock 110 of FIG. 4A slides between a locked position and an unlocked position. In the locked position, the lens lock 110 engages with the shell locking channel 302, which is positioned within the lens channel 204, to resist removal of the lens 104 from the lens channel 204. For example, a protrusion 306 of the lens lock 110 extends into the lens channel 204. When the lens lock 110 moves from the unlocked position (shown as unlocked position 308 in FIG. 3B) to the locked position (shown as unlocked position 310 in FIG. 3B) while the shell locking channel 302 is seated in the lens channel 204, the protrusion 306 moves into a locking engagement with the shell locking channel 302, which may involve further tightening the lens 104 against the lens insertion flange 206 due to the angle of the shell locking channel 302 with respect to the protrusion 306. To release the lens 104, the protrusion 306 is moved to the unlocked position 308 by sliding the lens lock 110 to the unlocked position, which may be marked on the shell 102.

Figure 4B:
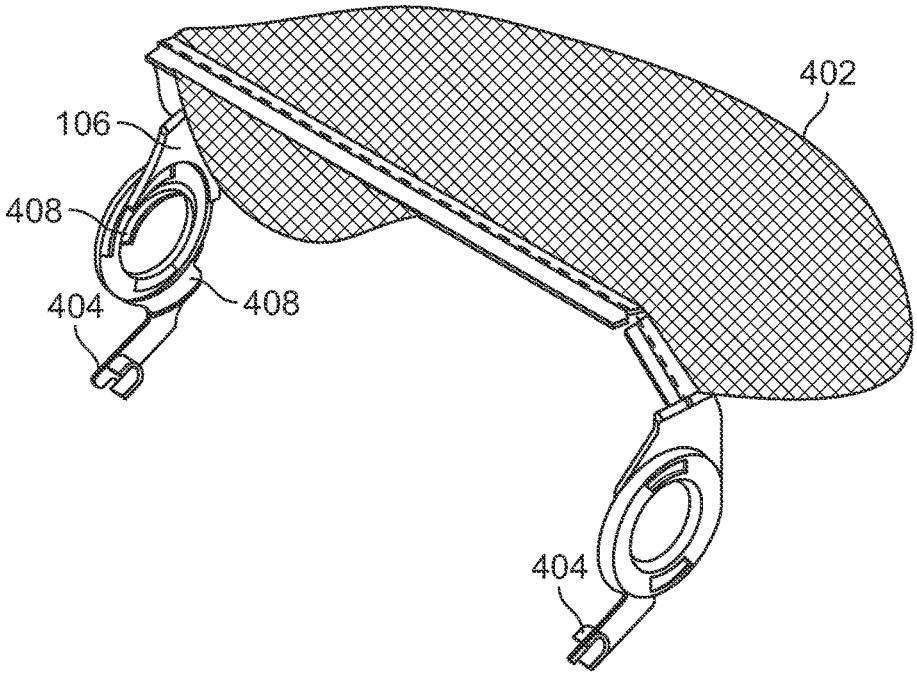
FIG. 4B is a more detailed view of the example head seal of FIG. 4A.

The example head seal 106 is attached to an interior surface of the shell 102, near the upper rear edge of the shell 102. For example, the interior surface of the shell 102 may include a seal channel into which the head seal 106 is seated to limit air flow between the head seal 106 and the shell 102. FIG. 4B is a more detailed view of the example head seal 106.

Figure 4C:
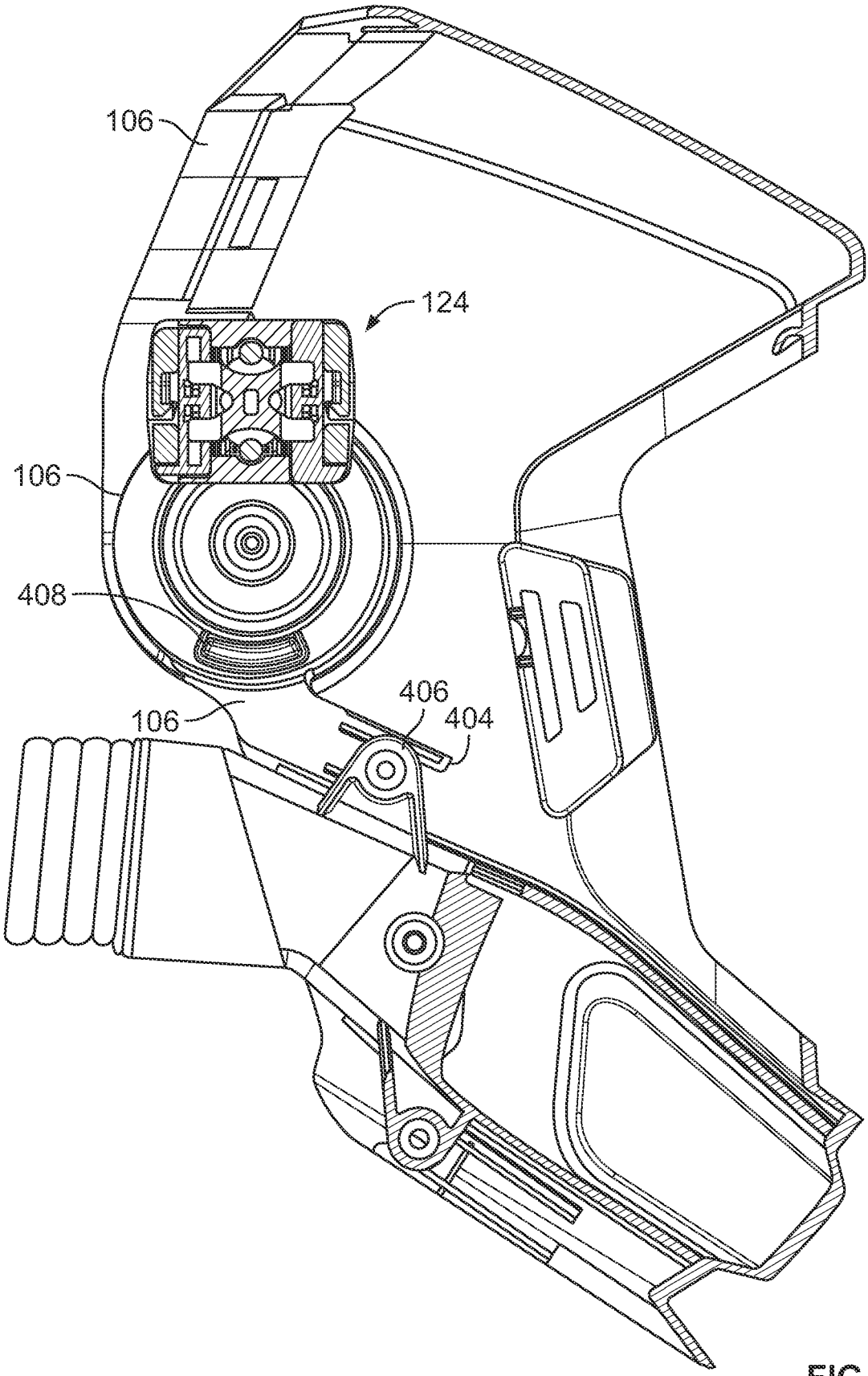
FIG. 4C is a cross-sectional view of the face shield system of FIG. 1 illustrating the head seal attached to the shell and the air ducts.

As illustrated in FIG. 4A and FIG. 4B, the head seal 106 may be attached to the shell 102 near the pivoting clips 124. FIG. 4C is a cross-sectional view of the face shield system 100 illustrating the head seal 106 attached to the shell 102 and the air ducts 112. The example head seal 106 includes clips 404 that support the head seal 106 via corresponding protrusions 406 from the air ducts 112. The head seal 106 further includes locking tabs 408 arranged on a circular portion 410 of the head seal 106. The circular portion 410 permits the head seal 106 to be attached to the shell 102 around the pivoting clips 124.

In some examples, the head seal 106 and/or the chin seal 118 are constructed from a molded plastic, 3D printed plastic, silicone, and/or any other appropriate material.

The example head seal 106 is attached to the shroud 402, which may then be wrapped over the user's head 108. In the example of FIGS. 4A and 4B, the shroud 402 is sewn to the head seal 106. However, other methods of attachment may be used based on the materials of the shroud 402 and/or the head seal 106, such as gluing or other adhesion, ultrasonic welding, clipping, clamping, and/or any other techniques. In the example of FIGS. 4A and 4B, the shroud 402 is sewn to the side of the head seal 106 that contacts the shell 102. In this manner, the head seal 106 may be constructed to be thin enough that the head seal material can be pierced by a sewing needle for attachment of the shroud 402. The shroud 402 may further be provided with an elastic edge opposite the edge attached to the head seal 106 to improve conformity to the user's head 108 and limit air exchange from the volume under the shroud 402 (e.g., adjacent the user's head 108 with the environment.

In some examples, the shroud 402 may be further coupled to the chin seal 118 and extend down to the user's neck. In such examples, the elastic edge may be configured to permit the user's head 108 to pass through the elastic edge, and then contract the edge around the user's neck to limit air exchange without restricting the user's breathing or circulation. The shroud 402 may be constructed using any appropriate flexible, airtight material. In some examples, the shroud 402 may comprise an impregnated fabric, a closed cell foam, a plastic sheet, a woven plastic fabric, and/any similar material or combination of materials.

Figure 5A:
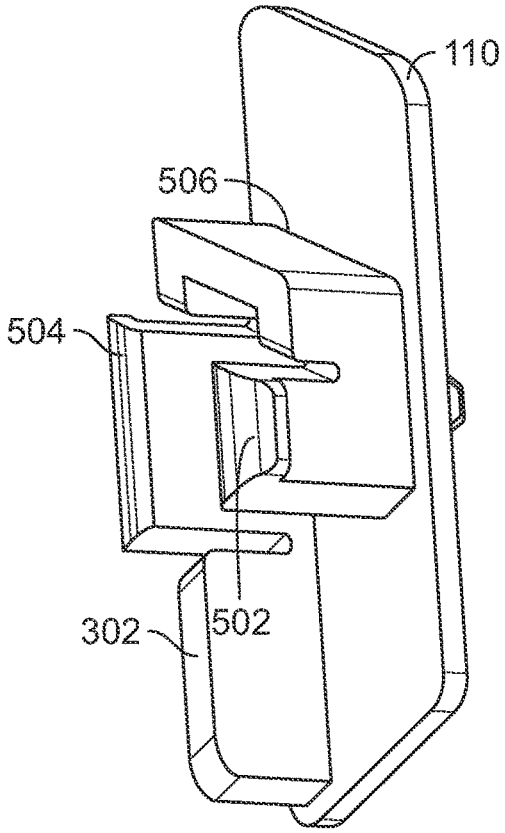
FIG. 5A is a perspective view of the example lens lock of FIG. 1.
Figure 5B:
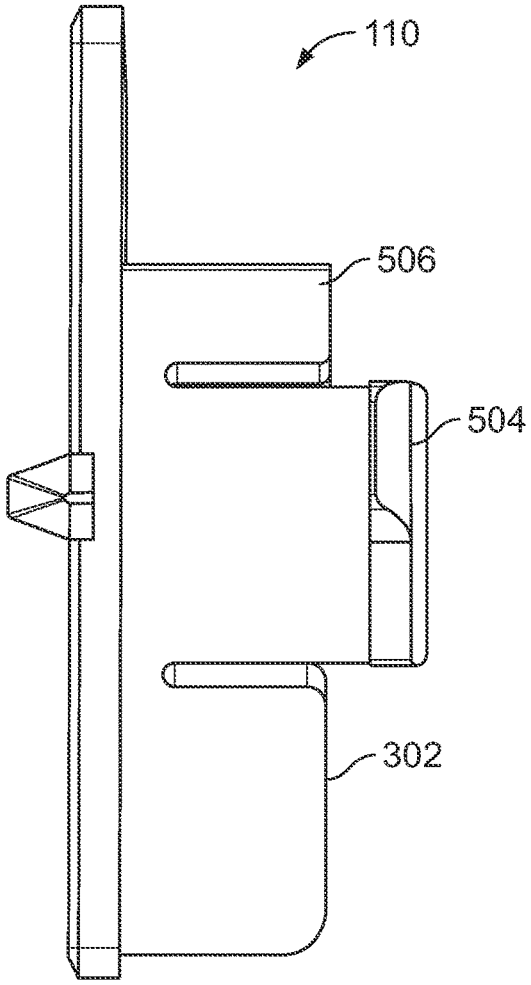
FIG. 5B is an elevation view of the lens lock of FIG. 1.

FIG. 5A is a perspective view of the example lens lock 110, and FIG. 5B is an elevation view of the lens lock 110. As shown in FIGS. 5A and 5B, the lens lock 110 includes the protrusion 306 which engages and disengages the shell locking channel 302 of the lens 104. The example lens lock 110 further includes clips 502, 504 that retain the lens lock 110 within the lens lock track 210. The protrusion 306 and the shell locking channel 302 provide a limit on translation of the lens lock 110 in a first direction (e.g., a locking direction) along the lens lock track 210. The example lens lock 110 includes a motion stop 506 that provides a limit on translation of the lens lock 110 in a second direction (e.g., an unlocking direction) along the lens lock track 210.

As previously described, the lens lock 110 in described examples moves in a linear track. However, in other examples the lens locks may move along a curved track to lock and unlock the lens 104. For example, the lens lock may have a curved shape instead of the linear shape as illustrated in FIGS. 1-4C.

Additionally or alternatively, instead of a lens lock track, the lens lock may rotates about a lock pivot point. The lens locks mentioned may or may not use a similar shell lock channel as described above. In some examples, only the inner surface or the outer surface may be supported and used to create the seal around the lens lock.

In some examples, the lens lock may be provided with a backup lock to further prevent the lens lock 110 from being opened inadvertently while in use. For example, the backup lock may limit movement of the lens lock 110 until the backup lock is physically unlocked by the user, at which time the lens lock 110 may be moved. In other examples, the backup lock may rotate, may be a recessed spring loaded button, or any other similar configuration to limit or prevent the movement of the lens lock 110.

In some examples, the lens lock 110 may be biased into a locked position by a biasing element. For example, a spring may be attached between the lens lock 110 and a stationary point on the face shield shell 102 to provide a tensile force to move the lens lock 110 from the unlocked position to the locked position and/or to help keep the lens lock 110 in the locked position. In other examples, the spring could be a rubber band, an air piston, or any other similar component to provide a biasing force.

As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. For example, blocks and/or components of disclosed examples may be combined, divided, re-arranged, and/or otherwise modified. Therefore, the present method and/or system are not limited to the particular implementations disclosed. Instead, the present method and/or system will include all implementations falling within the scope of the appended claims, both literally and under the doctrine of equivalents.

What is claimed is:

1. A face shield, comprising:

a face shield lens comprising a locking channel;

a face shield shell configured to receive the face shield lens when the face shield lens is inserted into the face shield shell, the face shield shell comprising a lens channel configured to retain a portion of the face shield lens when the face shield lens is in the inserted position, wherein the lens channel comprises a lens centering contour, wherein the face shield lens further comprises a channel centering indent, and the lens centering contour is configured to abut against the channel centering indent thereby aligning the lens within the lens channel; and a lens lock configured to move between:

a locked position in which the lens lock is configured to engage the locking channel of the face shield lens to secure the face shield lens to the face shield shell; and an unlocked position in which the lens lock is configured to disengage the locking channel of the face shield lens to permit insertion of the face shield lens to the face shield shell and removal of the face shield lens from the face shield shell, wherein the lens lock is configured to move from the locked position to the unlocked position by sliding along the face shield shell.

2. The face shield as defined in claim 1, wherein the face shield lens is configured to be inserted and removed from the face shield shell without deforming the face shield shell or the face shield lens.

3. The face shield as defined in claim 2, wherein the face shield lens is at least 0.07 inches thick.

4. The face shield as defined in claim 1, wherein the face shield shell further comprises an upper portion, a lower portion, and two side portions; and the lens lock is located on a face shield shell side portion.

5. The face shield as defined in claim 4, wherein at least one lens lock is located on both of the face shield shell side portions.

6. The face shield as defined in claim 1, wherein the lens channel further comprises a lens insertion flange configured to abut against the face shield lens to limit a distance the lens is inserted into the lens channel.

7. The face shield as defined in claim 1, wherein the lens lock further comprises a lock pivot point and the lens lock is configured to rotate about the lock pivot point when moving from the locked position to the unlocked position.

8. The face shield as defined in claim 1, further comprising a duct configured to direct air from a hose connector to an outlet for directing the air to a face of a wearer of the face shield.

9. The face shield as defined in claim 1, wherein the face shield lens and the face shield shell are configured to not provide an airtight seal when the face shield lens is secured to the face shield shell via the lens lock.

10. The face shield as defined in claim 1, further comprising a suspension system configured to support the face shield shell and the face shield lens on a head of a wearer of the face shield.

11. A face shield comprising:

a face shield lens comprising a locking channel;

a face shield shell configured to receive the face shield lens when the face shield lens is inserted into the face shield shell, the face shield shell comprising a lens channel configured to retain a portion of the face shield lens when the face shield lens is in the inserted position, wherein the lens channel comprises a lens centering contour, wherein the face shield lens further comprises a channel centering indent, and the lens centering contour is configured to abut against the channel centering indent thereby aligning the lens within the lens channel;

a head seal configured to limit movement of air between a head of a user of the face shield and an environment outside of the face shield; and a lens lock configured to move between:

a locked position in which the lens lock is configured to engage the locking channel of the face shield lens to secure the face shield lens to the face shield shell; and an unlocked position in which the lens lock is configured to disengage the locking channel of the face shield lens to permit insertion of the face shield lens to the face shield shell and removal of the face shield lens from the face shield shell.

12. The face shield as defined in claim 11, wherein the head seal comprises a molded plastic.

13. The face shield as defined in claim 11, further comprising a head shroud attached to the head seal and configured to limit movement of air between a portion of the head of the user behind the head seal and the environment.

14. The face shield as defined in claim 13, wherein the head shroud comprises at least one of a fabric, a foam, or a polymer sheet.

15. The face shield as defined in claim 13, wherein the head seal is attached to the head shroud by a sewn thread seam, ultrasonic welding, or an adhesive.

16. A face shield, comprising:

a face shield lens comprising a locking channel;

a face shield shell configured to receive the face shield lens when the face shield lens is inserted into the face shield shell; and a lens lock configured to move between:

a locked position in which the lens lock is configured to engage the locking channel of the face shield lens to secure the face shield lens to the face shield shell; and an unlocked position in which the lens lock is configured to disengage the locking channel of the face shield lens to permit insertion of the face shield lens to the face shield shell and removal of the face shield lens from the face shield shell, wherein the lens lock comprises a protrusion configured to:

extend into a lens channel of the face shield shell in a first direction, wherein the lens channel is configured to receive the locking channel of the face shield lens in a second direction;

engage the locking channel when the lens lock is moved along a path defined by the face shield shell to the locked position; and disengage the locking channel when the lens lock is moved along the path defined by the face shield shell to the unlocked position, wherein the lens lock comprises a clip configured to retain the lens lock within the lens channel and to retain the protrusion within the lens channel.

* * * * *